United States Patent [19]

Crawford et al.

[11] 4,412,659

[45] Nov. 1, 1983

[54] SHREDDING MILL

[75] Inventors: Roger Crawford; Duane Sanders, both of Spokane, Wash.

[73] Assignee: Thermoguard Insulation Co., Spokane, Wash.

[21] Appl. No.: 229,661

[22] Filed: Jan. 30, 1981

[51] Int. Cl.[3] ..... B02C 13/02

[52] U.S. Cl. ..... 241/35; 241/57; 241/186.2

[58] Field of Search ..... 241/35, 37, 38, 60, 241/186 R, 186.2, 186.4, 189 A, 189 R, 190, 57

[56] References Cited

U.S. PATENT DOCUMENTS

| | | | |
|---|---|---|---|
| 1,476,032 | 12/1923 | Aicher et al. | 241/194 |
| 1,549,970 | 8/1925 | Hall . | |
| 2,171,463 | 8/1939 | Tschauner | 83/11 |
| 2,637,599 | 5/1953 | Fitzpatrick | 241/60 X |
| 2,650,745 | 9/1953 | Oberwortman . | |
| 3,066,878 | 12/1962 | Wildbolz | 241/47 X |
| 3,179,140 | 4/1965 | Satake | 146/285 |
| 3,286,745 | 11/1966 | Meis | 241/277 X |
| 3,333,777 | 8/1967 | Highfill, Jr. et al. | 241/47 |
| 3,483,906 | 12/1969 | Moeller | 146/123 |
| 3,615,059 | 10/1971 | Moeller . | |
| 3,942,729 | 3/1976 | Fredriksson | 241/38 |
| 3,967,785 | 7/1976 | Grosch | 241/28 |
| 4,033,515 | 7/1977 | Barcell et al. | 241/27 |
| 4,066,216 | 1/1978 | Waldrop et al. | 241/190 |
| 4,134,554 | 1/1979 | Morlock | 241/35 |

*Primary Examiner*—Mark Rosenbaum
*Assistant Examiner*—Timothy V. Eley
*Attorney, Agent, or Firm*—Wells, St. John & Roberts

[57] ABSTRACT

A mill is described for progressively shredding material such as garbage, tires, aluminum cans, waste paper, etc. into loose particulate material. The mill includes a hopper that is movably mounted to a shredding wheel frame. The hopper includes an open bottom end into which the shredding wheel projects. The hopper is driven to reciprocate along a straight path over the wheel to bring the contained material into wheel contact. Provision is made to vary the depth of cut taken by the wheel in response to loading conditions of the associated drive motor by automatically adjusting a feed grate mechanism relative to the wheel.

7 Claims, 6 Drawing Figures

SHREDDING MILL

BACKGROUND OF THE INVENTION

The present invention is related to apparatus for shredding material such as garbage, tires, aluminum cans, or waste paper into a particulate material, and particularly to such machines that use a moving hopper and rotatable shredding wheel.

Waste and other products such as used newsprint are rapidly gaining value as a raw material. Paper, for example, can be used for production of loose fill cellulose insulation. Materials such as paper products must be carefully shredded to a select consistency to produce a quality finished product. This is a difficult task, especially due to the form and variety of paper product materials normally used. The product can "bridge" in a stationary hopper over a shredding wheel, or, at best, feed unevenly into the wheel. The wheel therefore will produce a variable discharge of particulate or operate inefficiently under an excessive load. The particulate quality and quantity depends upon several factors including but not limited to feed rate, wheel speed, and depth of cut by the shredding wheel. None of these factors are adequately controlled by known forms of particulate producing apparatus.

U.S. Pat. Nos. 2,650,745; 3,483,906; 3,615,059 and 3,967,785 all disclose material receiving hoppers that move relative to a rotating shredding, grinding or cutter wheel in recognition of the feed problem associated with stationary hoppers. The disclosed hoppers are typically rotated or oscillated about an axis that is vertical and perpendicular to a horizontal cutter wheel. The cutter wheel axis intersects the hopper axis so the wheel is actually on a radius from the hopper axis. The hoppers can be rotated at a selected speed. However, the speed of the product passing the wheel cannot be accurately set. This is true firstly because the speed of materials at the radially inward wheel end is substantially slower than the material traveling past the outward wheel end. Secondly, there is no rigid backing working against the material to force it into the wheel. A blockage occurring at the wheel could result merely in the product stopping behind the blockage and thereby halting the product feed to that area.

Another difficulty with rotating hoppers and shredding or grinding devices is wear. Rotational feed produces forces that are both perpendicular to the wheel axis and radially oriented. Thus, to avoid excessive wear, bearing mounts for the wheel must have the capability to withstand both directional forces. Such bearings are expensive and typically wear more quickly than ordinary lateral load receiving bearings.

Finished material consistency can be partially controlled by varying the speed of the wheel or feed rate proportionally with the load applied to the wheel drive. U.S. Pat. Nos. 3,179,140 and 1,549,970 both disclose circuitry for controlling operation of electric drive motors for affecting such control. Pat. No. 1,549,970 shows circuitry controlling a hopper feed device that is operated in response to a detected load on the wheel drive motor. Pat. No. 3,179,140 discloses a load controlling arrangement for grain polishing machines in which a hopper feed opening in communication with a grain polishing wheel is varied in size in response to detected current load on the polishing wheel drive motor.

U.S. Pat. No. 2,171,463 to Tschauner discloses a fixed hopper type crusher with an adjustable resilient feed grate over a rotatable crusher wheel. The feed grate can be manually adjusted radially with respect to the wheel axis in order to control depth of cut for the wheel. This adjustment is not precise due to the resilient nature of the grate. Additionally, adjustment cannot be easily made in response to varying loading conditions. U.S. Pat. No. 4,033,515 to Barcell, and No. 4,066,216 to Waldrop show fixed grate arrangements on feed hoppers.

The present mill includes a translationally reciprocating hopper that moves the product in a straight line normal to the axis of a shredding wheel, avoiding "bridging" and axial wheel loading. Material feed is controlled by raising or lowering a grate radially in relative to the wheel. The grate controls depth of cut and loading on the wheel drive motor. The grate is secured in its adjusted positions for consistent particulate discharge.

BRIEF DESCRIPTION OF THE DRAWINGS

A form of the present invention is illustrated in the accompanying drawings in which.

DETAILED DESCRIPTION OF A PREFERRED EMBODIMENT

The present mill is shown generally at 10 in the accompanying drawings. The present mill 10 is provided for operation on varied materials such as garbage, aluminum cans, waste paper, etc. that can be shredded for production of a loose particulate material. The apparatus disclosed hereafter will be described as a waste paper shredding machine for production of loose fill particulate cellulose insulation by way of example, it being understood that the machinery will also function to shred other materials.

Figure 2:
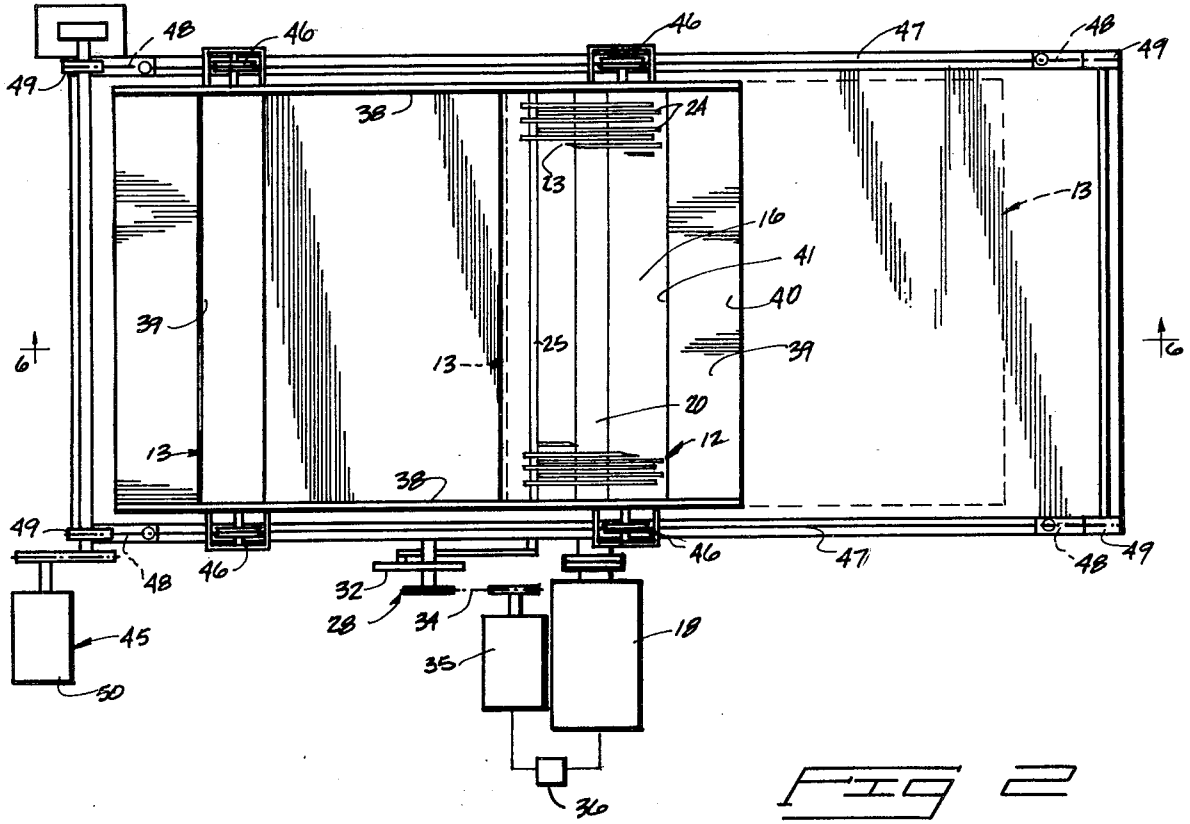
FIG. 2 is an enlarged fragmentary top plan view.
Figure 6:
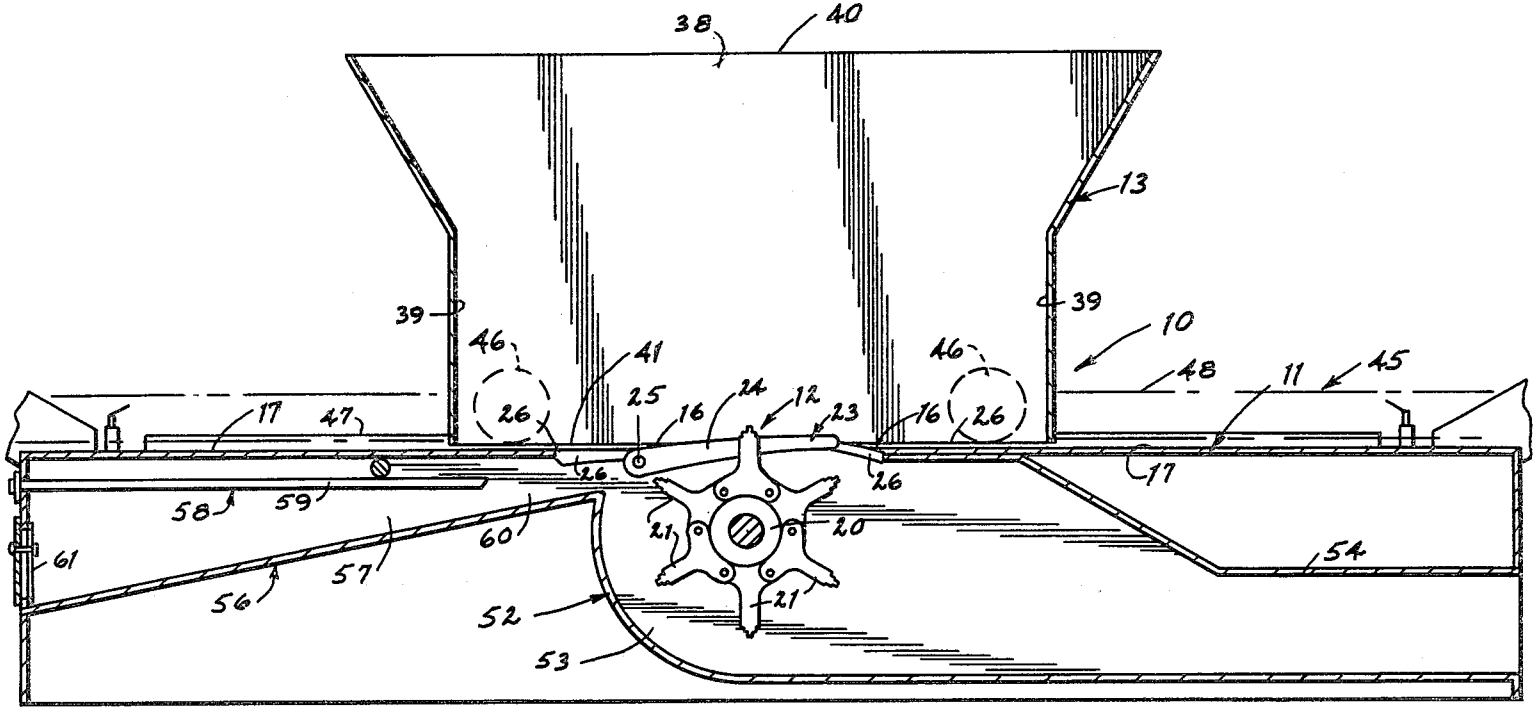
FIG. 6 is an enlarged sectional view taken along line 6—6 in FIG. 2.

The mill 10 includes an elongated rigid frame 11 that rotatably supports a shredding wheel 12 (FIGS. 2 and 6). A hopper 13 is mounted on the frame to reciprocate in a horizontal path in forward and return strokes over the shredding wheel 12.

Figure 1:
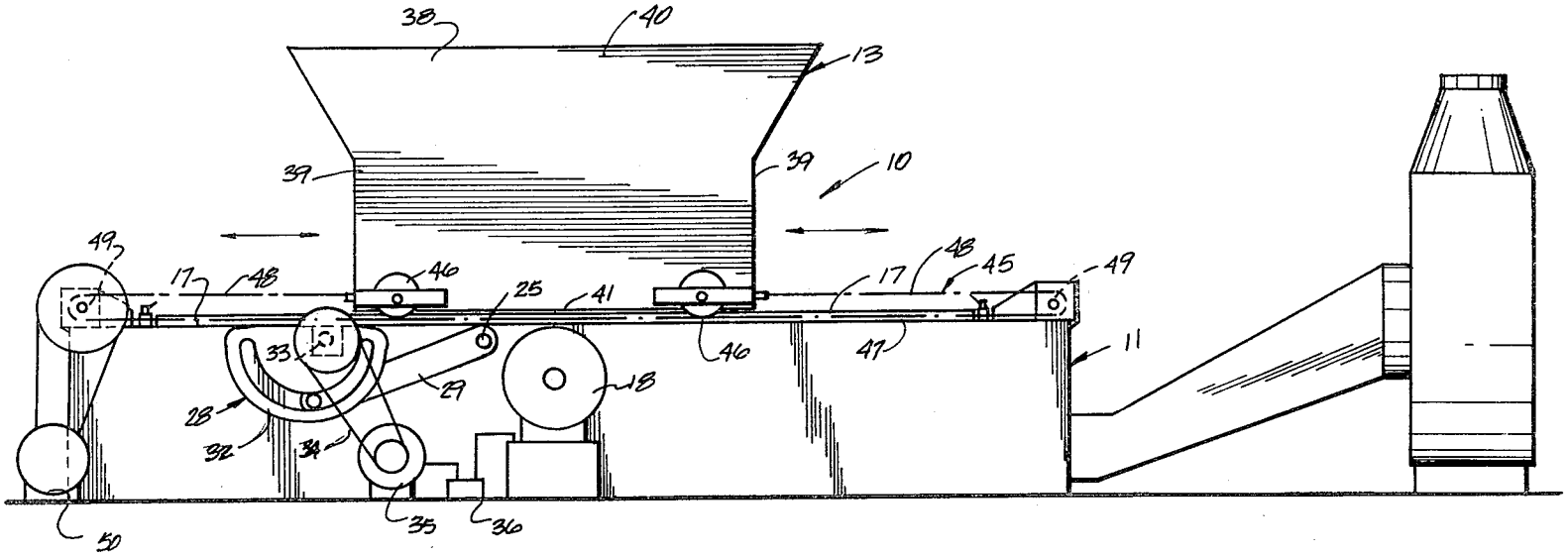
FIG. 1 is a side elevation view of the present mill.

The frame 11 is shown in substantial detail in FIGS. 1 and 6. The frame 11 includes an upwardly facing opening 16 through which the periphery of the wheel 12 projects. On opposite sides of the opening 16 are horizontal table top surfaces 17. The surfaces 17 extend longitudinally on opposite sides of the opening to the full length of the frame. The surfaces 17 are coplanar across the opening 16.

The wheel 12 is driven to rotate about a transverse horizontal axis by a motor 18. The motor 18 is preferably electric and interconnected with the wheel by its central shaft 20. The axis of the central shaft 20 is horizontal on the frame and situated directly below the opening 16 (FIG. 6) Radially projecting shredding members 21 (FIG. 6) are mounted to the central shaft along the length thereof. It is preferred that several of the members 21 be mounted to the shaft at equally spaced intervals along its length and at equally spaced angular intervals about the shaft periphery. The extreme ends of the members 21 are provided to engage and shred paper product as the wheel is rotated about its axis. The central shaft 20 is journalled in fixed horizontal position on the frame for rotation about its transverse central axis within the frame opening 16.

A feed grate means 23 (FIG. 4) is provided longitudinally across the opening 16 for guiding paper product over the shredding wheel and for defining a selected depth of cut for the shredding wheel. The feed grate means 23 is comprised of a number of fingers 24 that extend longitudinally across the opening from a pivot shaft 25. The shaft 25 rigidly mounts the fingers in parallel relationship to one another. The shaft and fingers are fixed to one another so pivotal movement of the shaft will result in pivotal movement of the fingers. The axis for the pivot shaft 25 is parallel to the rotational axis for the wheel. Additionally, the shaft axis is situated elevationally above the wheel axis and to one side of the opening 16.

Stationary fingers 26 are affixed to the frame and project slightly into the opening 16 from opposite sides thereof. The stationary fingers 26 project between adjacent pivotable fingers 24. The stationary fingers 26 serve to guide the paper product into engagement with the grate means and shredding wheel, and to permit pivotal movement of the pivoted fingers 24.

Figure 4:
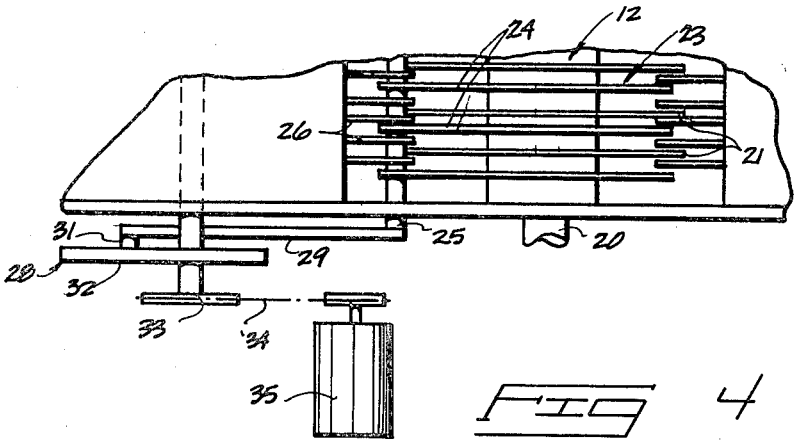
FIG. 4 is an enlarged fragmentary plan view of the shredding wheel and grate mechanism of the present invention.
Figure 5:
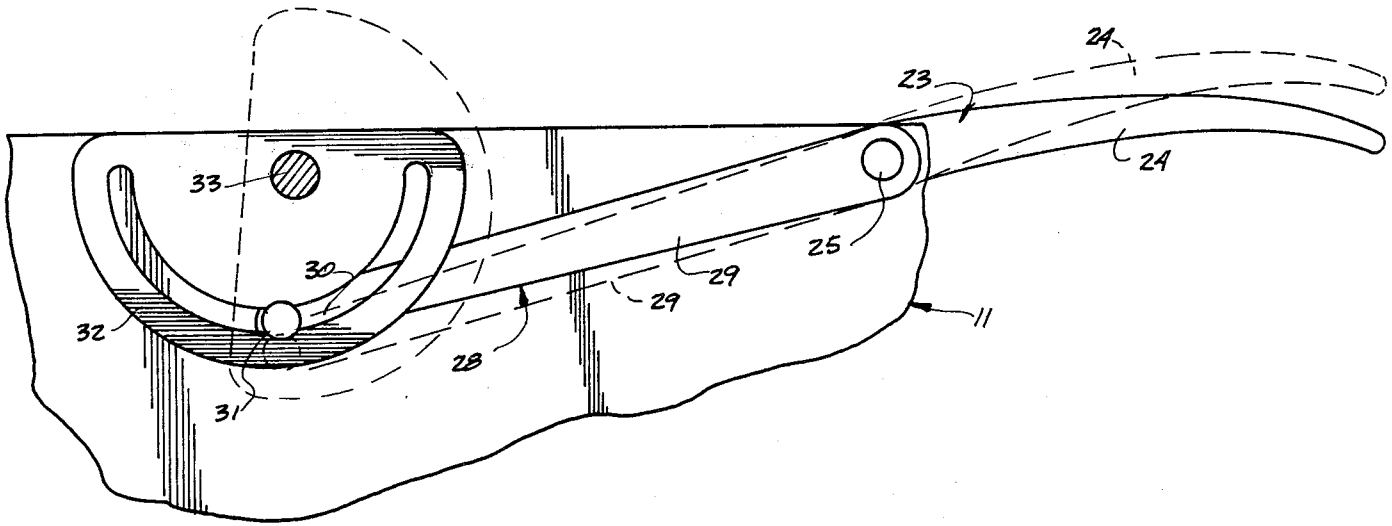
FIG. 5 is a detail view of a mechanism for automatically operating the grate mechanism to shift the grate radially relative to the wheel.

The fingers 24 are moved elevationally by an adjusting means shown generally at 28 (FIGS. 1, 4 and 5). The elevational adjusting means 28 is provided to adjustably fix the elevational position of the feed grate means in relation to the shredding wheel. This effectively adjusts the depth of cut for the rotatable shredding members 21.

The adjusting means 28 includes a lever arm 29 that is affixed to the finger pivot shaft 25. The lever 29 extends opposite the fingers to a free end 30. A follower 31 is mounted to this end to moveably engage an arcuate eccentric slot within a slot cam 32. The cam 32 is mounted at 33 to be rotated by a drive linkage 34 and motor 35 (FIG. 1). Operation of the motor 35 will thus result in pivotal motion of the slot cam 32 at its pivot 33. The eccentric slot thus works against the follower 31 and causes pivotal movement of the lever arm 29. The lever arm is fixed to the shaft 25 so pivoal movement thereof will cause corresponding pivotal movement of the fingers 24. Relative positions of the fingers 24 and elevational adjusting means 28 is illustrated by solid and dashed lines in FIG. 5.

The elevational adjusting means 28 is provided so the fingers 24 may be selectively set in a rigid radial position with respect to the shredding wheel axis. There is no resiliency in the adjusting mechanism or fingers. The fingers are held in the rigid positions in order to maintain a precise selected depth of cut for the shredding members 21.

FIG. 1 indicates a control means 36 interconnecting the adjusting means drive motor 35 and shredding wheel motor 19 for detecting a current load on the motor and actuating the elevational adjusting means to adjust the feed grate means elevationally in response to the detected load.

It is preferred that the control means 36 include a device such as a common ammeter for detecting the current load on the shredding drive motor 18. As the current load increased, appropriate conventional relays (not shown) will actuate the adjusting means 28 to elevate the fingers. The elevated fingers will decrease the depth of cut for the shredding wheel and reduce the current load on the motor. If the current load drops below a prescribed value, a second conventional relay (also not shown) will actuate the adjusting means to lower the fingers. The lowering fingers progressively increase the depth of cut for the shredding wheel and raise the current load on the shredding wheel drive motor 19 back to a normal load condition. Wear on the drive motor and shredding wheel components is therefore minimized.

Figure 3:
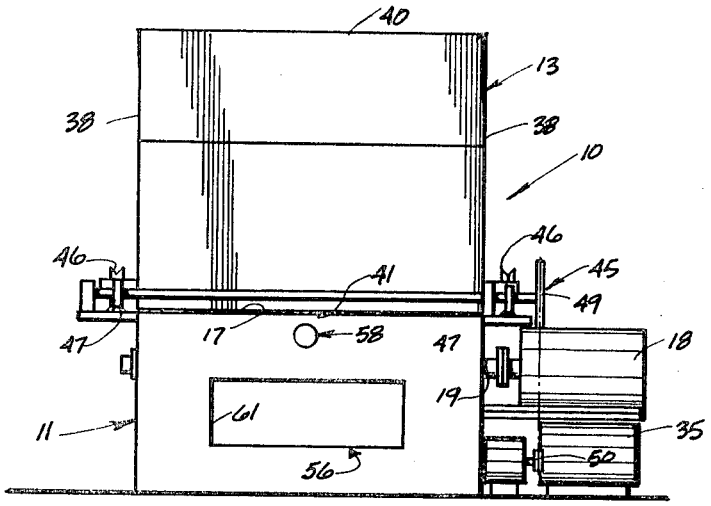
FIG. 3 is an end elevation view thereof.

The hopper 13 as shown in FIGS. 1 through 3 is somewhat rectangular in configuration, having upright side walls 38 spaced to opposite ends of the shredding wheel 12 and substantially perpendicular to the table surfaces 17 of the frame. The side walls 38 are parallel to one another and joined at opposed ends by inclined end walls 39. The end walls 39 extend transversely across the width of the frame and are substantially parallel to the rotational axis for the wheel 12. The walls 39 serve to engage and force the product positively over the shredding wheel. The walls 38 and 39 define a top opening 40 through which the hopper may be loaded with bulk paper products. The walls 38 and 39 also define an open bottom 41 in direct communication with the wheel 12.

The hopper is moved over the horizontal table surface 17 of the frame by a hopper drive means 45. This means 45 may include rollers 46 on the hopper side walls rotatably engaging parallel longitudinal tracks 47 on the frame. The rollers 46 allow free translational movement of the hopper in forward and return strokes along the horizontal, translational path defined by the tracks. The stroke length is such that at the extreme end of a stroke, one end wall or the other is situated directly adjacent the opening 16. These positions are shown in FIG. 2 by solid and dashed lines respectively.

The tracks and rollers are arranged relative to one another so the hopper bottom opening 41 will slide directly on the table top surface 17 of the frame. Therefore, paper product held within the hopper will be supported on the table surface 17 and move within the hopper as it is reciprocated by the hopper drive means.

The hopper drive means 45 further includes a chain 48 (shown in dashed lines) that is connected at opposite ends to the opposite hopper end walls 39. The chain extends in opposite directions from the ends 39 over sprockets 49 at opposed ends of the frame. The chain is operatively connected to a drive motor 50. The motor 50 can be operated in forward and reverse directions to alternately pull the hopper in forward and return strokes along the tracks 47. The stroke length is sufficient to bring the end wall 39 into close proximity with the adjacent edges of the table opening 16 so the hopper interior is constantly exposed to the wheel. The walls 39 thus function to positively push the paper product back and forth over the shredding wheel.

FIG. 6 illustrates the interior of the rectangular frame 11 including a chute means 52. The chute means 52 is comprised of a housing 53 partially surrounding the wheel 12. A discharge duct 54 is openly connected to the housing 53 for guiding shredded material received from the wheel outwardly of the mill. This material may be received within the input duct of a blower or other appropriate mechanism to receive the shredded material for further processing and to produce suction within the chute means.

An air bleed means 56 (FIG. 6) is provided, opening into the housing 53 for allowing passage of a selected amount of exterior air into the housing 53. The bleed means 53 includes a duct 57 leading from a small opening 60 in the housing to a dampered opening 61 along an outside end of the frame. The outside opening 61 can be selectively adjusted to control the amount of air entering into the housing. Additionally, a chemical feed means 58 is situated within the air bleed means 56 to facilitate application of a liquid or dry chemical to materials passing through the housing 53. The chemical feed means 58 is simply comprised of an elongated fluid delivery tube 59 situated within the duct 57 with a free end near the reduced duct opening 60. Chemical liquids may be drawn through the tube by venturi action within the duct adjacent the opening thereof into the housing.

During operation, paper products are fed directly into the hopper through its upper top opening 40. A bulk supply of the paper product may be received within the hopper before and during operation of the mill. To initiate operation of the mill, the associated blower or other mechanism is activated to produce a suction force through the chute means 52.

The control means 36 is then actuated by conventional automatic or manual controls (not shown) to lift the grid means to an elevated position above the ends of the shredding members 21. The motor 19 can then be activated to begin rotation of the shredding wheel. The shredding wheel will rotate without load due to the elevated support position of the fingers 24, holding the paper product above the wheel. At this time, the hopper drive means 45 can be actuated to initiate horizontal reciprocating motion of the hopper on the frame.

The control means 36, once the wheel and hopper are activated, can sense that there is no load applied to the wheel drive motor and, in response, will activate the motor 35 to lower the feed grate. The fingers will move between adjacent shredding members 21, exposing their ends to the paper product held within the hopper.

The fingers will begin shredding the product continuously as the hopper is reciprocated in the forward and return strokes along the table. Additional charging of paper product within the hopper may produce a heavy resistance against the rotating shredding members 21. In response the motor 19 will draw more current. The current change is sensed by the control means 36 which then actuates the elevational adjusting means 28 to raise the feed grate 23, lifting the paper product slightly to decrease the cutting depth for the shredding members. Thus, the load on the motor is maintained at a relatively constant value.

The shredded product is drawn downwardly into the housing 53 and subsequently through the duct 54 to further processing apparatus. The amount of suction applied through the chute means is selectively controlled through the air bleed means. Additionally, a prescribed amount of liquid can be fed through the chemical feed means 58 in order to produce a spray of the selected liquid across the shredded particulates as they drop into the housing.

The above description and attached drawings are given by way of example to set forth a preferred form of the invention. Other forms may be envisioned which fall within the scope of the invention as set forth in the following claims.

What we claim is:

1. A shredding mill for shredding material to produce particulate material of a uniform size, comprising:

a frame extending in a longitudinal direction;

a flat table top surface extending in the longitudinal direction on the frame having a shredding wheel opening formed in the surface intermediate ends of the table top surface;

said shredding wheel opening being defined by spaced end edges transverse to the longitudinal direction;

a material feed hopper reciprocally mounted on the frame for linear movement in the longitudinal direction immediately above the flat table top surface in continuous overlap of the shredding wheel opening;

said feed hopper having a top opening for receiving material to be shredded and upright end walls for directing the received material downward to a hopper bottom opening that is in open communication with the shredding wheel opening;

said hopper bottom opening having a longitudinal dimension between end edges substantially greater than the spaced distance between the transverse edges of the shredding wheel opening so that a portion of the received material is always supported on the table top surface and a portion of the material is always exposed to the shredding wheel opening;

a shredding wheel mounted on the frame in the shredding wheel opening for rotation about an axis transverse to the longitudinal dimension;

wheel drive means for rotating the shredding wheel as the feed hopper is being reciprocated to shred the material exposed to the shredding wheel opening;

hopper drive means on the frame for reciprocating the hopper in a defined stroke in which the bottom opening of the hopper is always in open communication with the shredding wheel opening and the shredding wheel is never exposed by being covered by the material;

feed grate means at the shredding wheel opening for guiding the material over the shredding wheel opening and for defining a selected cut of the material by the rotating shredding wheel;

chute means on the frame below the hopper and adjacent the shredding wheel for receiving the particulate material and for directing the particulate material away from the shredding wheel;

wherein the chute means includes an upwardly open housing partially enclosing the shredding wheel and a discharge duct in open communication with the wheel through the housing and directed in the longitudinal direction;

air bleed means on the housing for allowing air into the housing from an area remote from the hopper and for directing the air across the wheel below the feed grate means to receive particulate material from the shredding wheel and carry it through the discharge duct.

2. The mill as claimed in claim 1 further comprising elevational adjusting means for adjustably fixing the elevational position of the feed grate means in relation to the shredding wheel.

3. The mill as claimed by claim 2 wherein the shredding wheel means is driven by an electric motor and wherein the elevational adjusting means includes means for detecting a load on the motor and for actuating the elevational adjusting means to adjust the feed grate means elevationally in response to loading of the motor.

4. The mill as claimed in claim 1 further comprising chemical feed means within the air bleed means for dispensing chemicals within the housing.

5. The mill as claimed by claim 1 wherein the feed grate means is comprised of:

a shaft mounted to the frame for pivotal movement thereon about a shaft axis parallel to the shredding wheel axis;

a plurality of spaced finger members affixed to the shaft for pivotal movement therewith and extending from the shaft over the wheel; and finger drive means for selectively pivoting the finger members abut the shaft axis to selected positions at varying radii from the axis of the shredding wheel.

6. The mill as claimed by claim 5 wherein the finger drive means includes:

a lever fixed to the shaft, extending outwardly therefrom to a free end;

a cam having a cam surface engaging the free end of the lever; and cam drive means for selectively rotating the cam surface against the free lever end to pivot the lever and fingers about the shaft axis.

7. The mill as claimed by claim 6 wherein the shredding wheel is driven by an electric motor and wherein the elevational adjusting means includes means for detecting loading of the wheel drive motor and for actuating the cam drive to adjust the radial position of the finger members toward or away from the rotational axis of the wheel.

* * * * *